United States Patent [19]

Strandli et al.

[11] 4,435,887

[45] Mar. 13, 1984

[54] METHOD OF MAKING PROJECTILE

[75] Inventors: Kaare R. Strandli; Arne M. Östlie, both of Raufoss, Norway

[73] Assignee: A/S Raufoss Ammunisjonsfabrikker, Raufoss, Norway

[21] Appl. No.: 452,087

[22] Filed: Dec. 22, 1982

Related U.S. Application Data

[62] Division of Ser. No. 248,539, Mar. 27, 1981.

[51] Int. Cl.[3] ..... B21K 21/06

[52] U.S. Cl. ..... 29/123

[58] Field of Search ..... 29/1.2, 1.21, 1.22, 29/1.23; 102/518, 517, 520

[56] References Cited

U.S. PATENT DOCUMENTS

| | | | |
|---|---|---|---|
| 1,150,667 | 8/1915 | Dunwoody | 102/518 |
| 1,248,656 | 12/1917 | Henry | 102/518 |
| 2,564,870 | 8/1951 | Weiss | 102/518 |
| 3,731,630 | 5/1973 | Muller | 102/518 |
| 3,782,287 | 1/1974 | Sie | 102/518 |

FOREIGN PATENT DOCUMENTS

| | | | |
|---|---|---|---|
| 73974 | 11/1944 | Czechoslovakia | 102/517 |
| 826922 | 4/1938 | France | 102/517 |
| 831497 | 9/1938 | France | 102/518 |
| 1533697 | 11/1978 | United Kingdom | 102/518 |

*Primary Examiner*—William R. Briggs
*Attorney, Agent, or Firm*—Larson and Taylor

[57] ABSTRACT

Improvements in a multi-capability projectile having a heavy primary penetration element surrounded by a splintering and fragmenting secondary penetration element which extends forwardly of the primary penetration element to form a cavity having a bursting charge therein, the projectile having a nose portion forwardly of that cavity with an ignition charge therein. The rear of the secondary penetration element is stepped inwardly to form a smaller recess which receives and holds the rear end of the primary penetration element. A shoulder adjacent this smaller rearward portion can be formed in accordance with an improved method with an annular groove, according to which the portion of that shoulder radially inwardly of the groove is urged against the side of the primary penetration element to form a rimmed part which secures the same. The annular space surrounding the forward end of the primary penetration element can be filled with an incendiary charge, the bursting charge being located forwardly thereof. The forward end of the secondary penetration element can be tapered inwardly to better confine the charge.

2 Claims, 4 Drawing Figures

METHOD OF MAKING PROJECTILE

This is a division of application Ser. No. 248,539 filed Mar. 27, 1981.

This application relates to improvements in the type of multi-capability projectile described in the Applicant's British Pat. No. 1,553,697, granted on Mar. 7, 1979, said patent being assigned to A/S Raufoss Ammunisjonsfabrikker, 2831 Raufoss, Norway. The complete specification of said patent was published on Nov. 29, 1978.

The present invention relates to a projectile comprising a primary penetration element and a secondary penetration element arranged around said primary penetration element, said projectile further comprising bursting and/or incendiary charges as well as means for the ignition of said charges.

Many proposals were previously known for the construction of projectiles which comprise various means for the ignition of a bursting and/or incendiary effect by the impingement of the projectile on a target, for example armour piercing projectiles having a hardened steel core or a core of tungsten carbide. Such projectiles have good penetration properties in heavy as well as lighter targets. They have, however, no fragmentation effect. These projectiles are characterized in that the armour piercing body is fired with full caliber from the gun. A ballistic cap ahead of the body gives it a ballistic form. The cap can be filled with a pyro-technical incendiary charge.

The armour piercing body can also be arranged within a mantel of for instance copper, so that the body or core of the projectile has a smaller caliber than the gun.

The armour piercing body can also be arranged within a sleeve having a caliber diameter and provided with a driving band. Said sleeve can consist of aluminum or steel. If aluminum is used, this is due to the fact that one desires the greatest possible weight of the core, which should be able to penetrate the target.

Such an armour piercing core can also be arranged in a light metal sleeve, for instance aluminum, or a light metal cover which again is pressed into a projectile mantel. The object of the light metal cover is to save weight, so that the core, which can be made from for instance tungsten carbide, can have as high a weight as possible.

All the projectile tubes discussed above are characterized in that only the armour piercing core or body penetrates a heavy target. Incendiary effects can be obtained, but no bursting or fragmentation effect is obtained behind the target. Against a light target the whole projectile will pass through without being splintered due to a fragmentation effect. The only splinter effect which can be obtained is in the case where the separate parts of the projectile fall apart. These parts will, however, have a small effect as splinters or fragments because they are flung in the same direction as the armour piercing core and they therefore will not damage the target substantially more than that which is obtained by the penetration of the armour piercing body.

Also previously known are bursting-incendiary projectiles having a construction in which the charge is situated in a sleeve or mantel which is provided with a fuse arranged in the nose of said sleeve. Such projectiles have a good splinter, incendiary and bursting effect when hitting lighter and partly also medium heavy targets, but against heavy armoured targets they give, however, a poor effect, said sleeve not being so arranged that it penetrates the target.

The said British Pat. No. 1,533,697 discloses a projectile which gives a considerable splinter, fragmentation and incendiary effect in lighter as well as heavier targets at the same time as the armour piercing properties against the most heavy targets are as good as if they were a purely armour piercing projectile.

According to the present invention, several improvements are provided for a multi-capability projectile of the type described in the said British Pat. No. 1,533,697.

In accordance with a first feature of the present invention, an improved means is provided for securing the secondary penetration element relative to the primary penetration element by inserting the rearward portion of the primary penetration element into a rearward portion of the secondary penetration element which has a smaller internal diameter, and wherein by the use of a tool, a groove is formed in the said rearward portion causing part of the said rearward portion to be forced against the primary penetration element, thereby forming a rim which positively secures the primary penetration element in place. This feature has the advantage of providing a means for securing the primary penetration element which is relatively economical, and which is nonetheless efficient and which has the advantage of facilitating release of the primary penetration element at the instant when such release is desired.

Another feature of the present invention, which feature is also an advantage of the new arrangement for securing the primary penetration element to the secondary penetration element is the provision of a space surrounding the primary penetration element, into which space an incendiary charge can be placed, thereby improving the incendiary effect of this projectile. The high explosive bursting charge, i.e. HE, would then be placed in the secondary penetration element forward of the incendiary charge.

A further feature of the present invention is the construction of the secondary penetration element whereby the forward end thereof is tapered inwardly, at least on the inner surface thereof, so as to provide a better confinement for the high explosive charge located therein (as compared for example to a completely cylindrical inside surface).

The objects and other advantages of the present invention will become apparent from the detailed description which follows.

The preferred embodiments will now be described with respect to the accompanying drawings wherein.

Referring now to the drawings, like elements are represented by like numerals throughout the several views.

Figure 1:
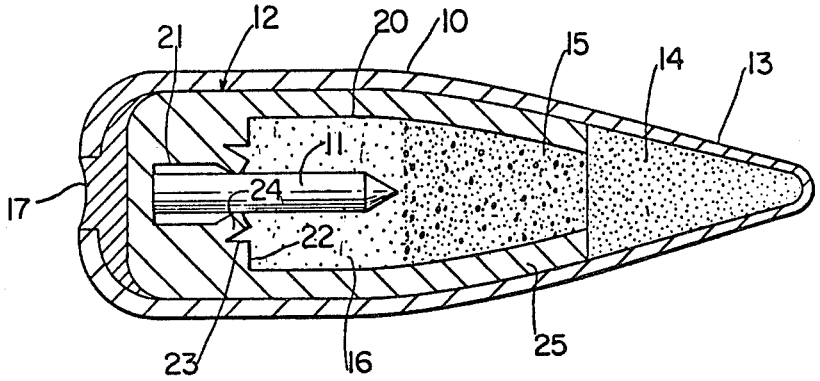
FIG. 1 is a central cross sectional view through a projectile which incorporates the features of the present invention.

Referring to FIG. 1, the projectile illustrated therein comprises a mantel 10 preferably made from copper or other convenient metal alloy. Within this mantel 10 there is provided a tubelike element 12 which constitutes a secondary penetration element. This element can be made from steel which is heat treated so that optimal piercing properties as well as a splintering and fragmenting effect can be obtained when this element hits a target.

Arranged within element 12 is the primary penetration element 11 which is preferably made from a heavy metal alloy, for example tungsten carbide with high solidity. Alternatively, element 11 can comprise a high-alloy steel, or steel which is heat treated to a high hardness.

The nose 13, which is formed by the forwardmost part of the mantel 10, includes therein an ignition charge 14 such as a suitable pyro-technical mixture which is ignited when the nose part 13 of the projectile is violently clinched. Within the element 12, at the forward end thereof, there is provided a high explosive bursting charge 15 such as HE powder.

One feature of the present invention is the means for securing the primary penetration element 11 in the secondary penetration element 12. As illustrated in FIG. 1, element 12 includes a rearward portion 21 of a relatively small internal diameter, a radially extending, axially facing shoulder 22, and a forward portion 20 of larger internal diameter. An annular groove 23 formed in the said shoulder 22 defines an annular rimmed part 24 which engages the primary element 11 and holds it in place.

Because of this holding action rearward of the front end of the primary penetration element 11, there remains an annular space 16 surrounding the primary element 11 and facing the inside wall of portion 20. It is another feature of the present invention that this space can be used to add additional incendiary material, to thereby improve the incendiary effect of the projectile, without detracting from its ability to fragment the secondary penetration element 12.

The forwardmost part of the element 12 comprises an inwardly tapered portion 25 which better contains the bursting charge 15. The rearwardmost part of the projectile is preferably closed by an end plug 17.

Figure 2:
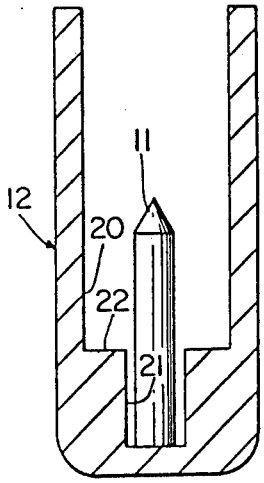
FIGS. 2 through 4 are cross sectional views of the primary and secondary penetration elements and illustrating in sequence the improved method for joining together the primary and secondary penetration elements.
Figure 3:
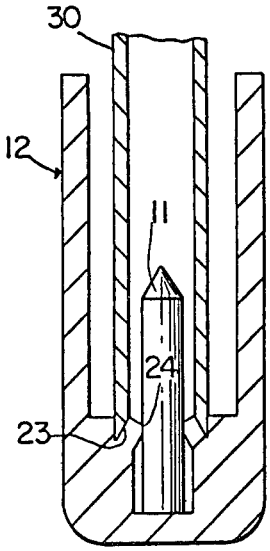
Figure 4:
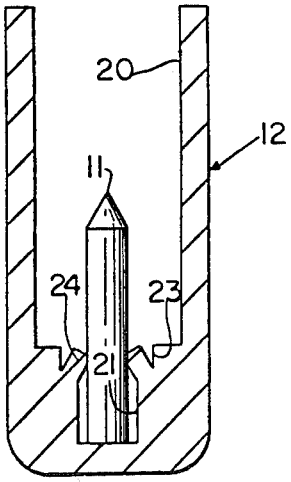

FIGS. 2 through 4 illustrate the method steps for securing the primary penetration element 11 in the secondary penetration element 12. Initially, both of the internal diameters 20 and 21 are cylindrical with the internal diameter 21 being slightly larger than the outside diameter of element 11 so that the rear portion of element 11 can be moved freely into said rearward portion 21. At this stage also the shoulder 22 is uninterrupted. Hence, there is the advantage of facilitating movement of the element 11 into the recess 21 as compared with other arrangements wherein a core body must be forced into the recess which secures it. With the element 11 in place, a tool 30, cylindrical in shape and having an annular downwardly facing edge, is forced into the shoulder 22, thereby forming groove 23 and forcing the portion of shoulder 22 radially inwardly of the tool 30 against the side surface of element 11, forming the rimmed part 24 which securely holds the element 11 in the element 12 as shown in FIG. 4.

A number of alternatives shown in the said British Pat. No. 1,533,697 can be used in the present invention. These include for example the provision of additional incendiary material at the very forwardmost part of the cavity 20, i.e. ahead of a somewhat smaller body of bursting charge. Also, the outer mantel 10 can be omitted with the secondary penetration element adapted to the caliber of the gun and provided with a circular driving band. The nose in this case would comprise a conventional ballistic cap. Also, if desired, a partition can be provided between the ignition charge and the incendiary and/or bursting charge located in the cavity formed by the secondary penetration element.

The mode of operation of the projectile according to the present invention is as follows:

When inpinging a light target, for instance the lighter part of an aeroplane, the nose 13 of the projectile will be clinched and the ignition charge 14 will be ignited. Before the charge in the bore 20 of the secondary penetration element explodes the entire projectile will, however, have pierced the target interior, whereat the charge will then explode and splinter or fragment the secondary penetration element 12 as well as the mantel 10. The primary penetration element 11 continues further into the target with a great piercing effect.

When the projectile hits a heavier target, for instance a medium heavy steel ship plate, the ignition charge 14 will be ignited by the violent clinching of the nose 13. By means of a combined incendiary and bursting effect of the charge in the bore 20 of the secondary penetration element 12, where an incendiary charge may be arranged between the bursting charge and the ignition charge, the secondary penetration element 12 penetrates the target plate before the bursting charge 15 splinters and fragments said element 12. The mantel 10, which is of a weak material, will usually not penetrate such a type of target, but will be peeled off on the outside of the plate.

When hitting such a heavy target, for instance an armoured car or tank or a heavy steel ship plate, the secondary penetration element 12 will not penetrate through the plate. The primary penetration element has, however, a considerable penetration effect in the same magnitude as that which can be obtained by an ordinary armour piercing projectile.

It will therefore be understood that a projectile according to the invention will have the desired properties of providing a full splinter, incendiary and fragmentation effect with both a light and medium heavy target. The projectile has a corresponding armour piercing property when hitting a heavy target.

Against targets consisting of a series of plates and target components arranged in series one behind the other, a projectile according to the invention has considerable advantages both compared with the armour piercing and the splintering/incendiary projectile. An air target is of this type. The projectile will, when hitting, be splintered after having penetrated the first plate. The splintering effect from the penetration of the secondary penetration element will be substantial against those plates or components being located behind the first plate. In addition thereto the primary penetration element will penetrate further through the target and can thereby damage those parts which are well protected. Thereby an action is obtained being a combined splintering, incendiary and fragmentation effect from a bursting/incendiary projectile immediately after the penetration, and then one will have a great penetration property due to the secondary penetration element similar to that which is obtained by an armour piercing projectile.

Although the invention has been described in considerable detail with respect to preferred embodiments thereof, it will be apparent that the invention is capable of numerous modifications and variations apparent to those skilled in the art, without departing from the spirit and scope of the invention, as defined in the claims.

We claim:

1. In the manufacture of a multi-capability projectile of the type having a heavy armour piercing primary penetration element surrounded over its full length by a secondary armour piercing penetration element which extends forward of the primary penetration element to form a cavity having a bursting charge therein, the secondary penetration element being constructed to splinter and fragment upon ignition of the bursting charge, and a nose portion ahead of the secondary penetration element and having an impact ignition charge therein, the improvement comprising attaching the primary penetration element to the secondary penetration element by the following steps:

taking the secondary penetration element, which has a large internal diameter front portion, a smaller internal diameter rearward portion and a radially extending, axially facing shoulder between the front and rear portions, and arranging said secondary penetration element in a position to receive the back end of the primary penetration element in the smaller internal diameter rearward portion, inserting the back of the primary penetration element, which back is cylindrically shaped, into the said smaller internal diameter rearward portion of the secondary penetration element, and forcing an annular tool down into the said shoulder to form an annular groove defining a rim radially inwardly thereof and forcing that rim into rimmed contact with the primary penetration element on the cylindrically shaped side thereof to positively secure the primary penetration element in said smaller internal diameter portion.

2. The method of claim 1, including, after the primary penetration element has been secured in the said smaller internal diameter rearward portion, and after the bursting charge has been placed into the cavity, tapering inwardly the front of the secondary penetration element to better hold the bursting charge therein.

* * * * *